United States Patent [19]

Vos et al.

[11] Patent Number: 4,802,708

[45] Date of Patent: Feb. 7, 1989

[54] REMOVABLE BOAT SEAT

[76] Inventors: Wilbur Vos; Donavon E. Musgrove, both of P.O. Box 84, Sully, Iowa 50251

[21] Appl. No.: 40,212

[22] Filed: Apr. 15, 1987

[51] Int. Cl.[4] ..... B63B 29/04

[52] U.S. Cl. ..... 297/252; 114/363; 243/231.4; 243/316.4; 297/240

[58] Field of Search ..... 297/148, 149, 151, 153, 297/240, 252, 400, 401; 108/49, 89; 248/231.4, 231.6, 316.4, 316.6, 424, 425, 429

[56] References Cited

U.S. PATENT DOCUMENTS

| | | | |
|---|---|---|---|
| 1,008,037 | 11/1911 | Johnson | 297/153 |
| 3,789,444 | 2/1974 | McCord | 297/252 X |
| 3,821,825 | 7/1974 | Bailey | 297/252 X |
| 4,307,865 | 12/1981 | MacCready | 248/424 |
| 4,373,756 | 2/1983 | Purdy et al. | 297/149 X |

*Primary Examiner*—Peter R. Brown
*Attorney, Agent, or Firm*—Kent A. Herink

[57] ABSTRACT

A portable boat seat for releasable attachment to a transverse boat thwart or any like horizontal supporting structure having opposing edges. A seat member is attached to a main frame by a turntable for rotation about a substantially vertical axis relative to the main frame and a supporting thwart. The main frame includes a pair of parallel, spaced apart longitudinal channel members to the upper surface of which is attached the turntable. Secured transversely across an end portion of the channel members is a first grasping member. A second and opposing grasping member is secured to a pair of slide members slidably engaging the channel members for relative longitudinal sliding movement. A coil spring biases the grasping members toward each other. Extension of the main frame against the spring permits the grasping members to be positioned adjacent and outside the opposing edges of the thwart. Upon release of the main frame, the grasping members engage the opposing edges to secure releasably the boat seat to the thwart.

1 Claim, 2 Drawing Sheets

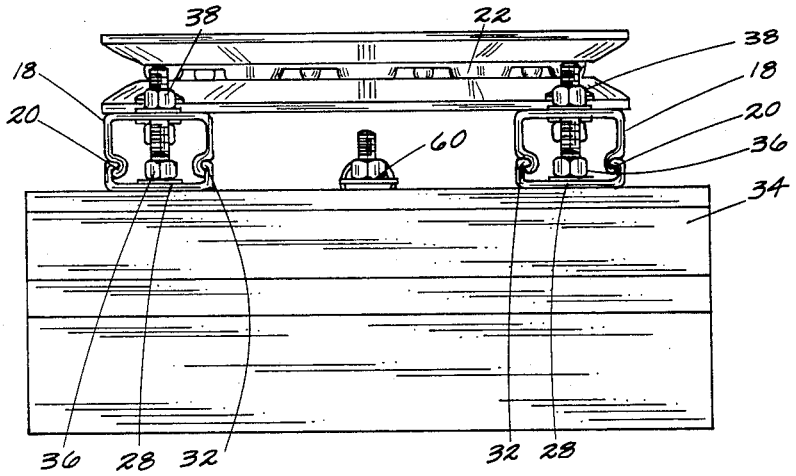
FIG. 4
FIG. 5
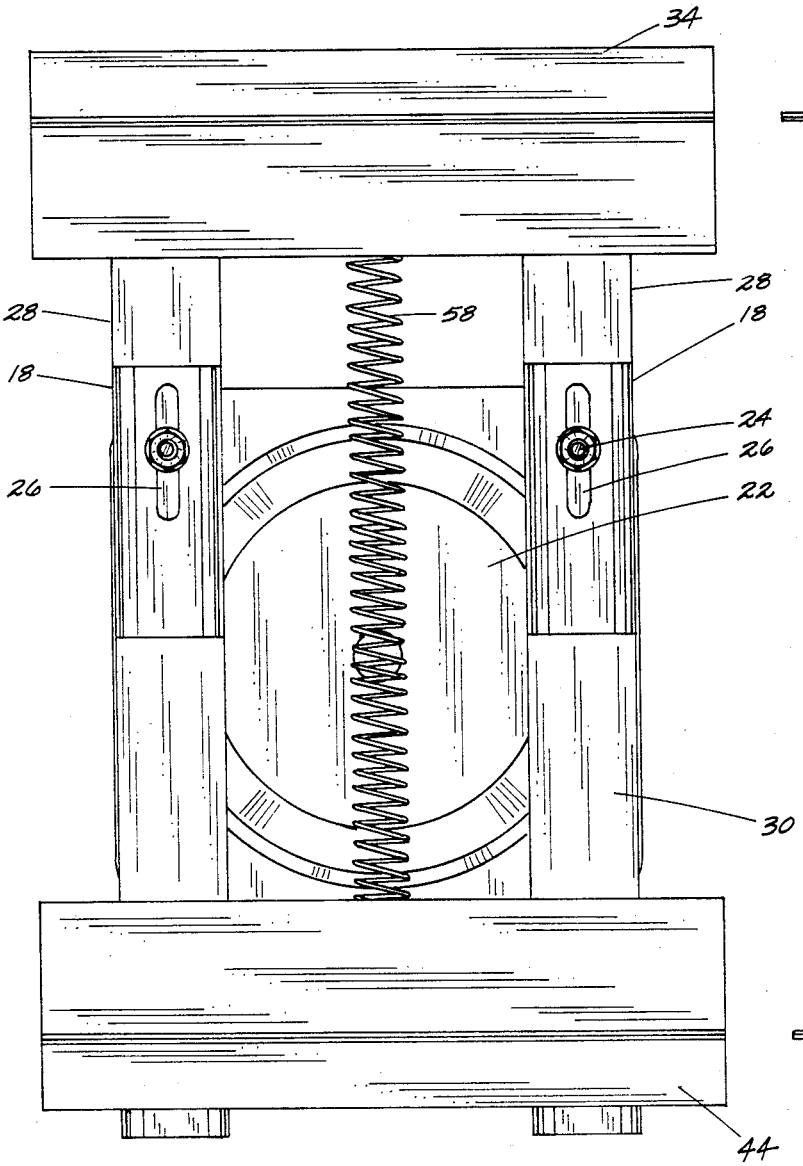
FIG. 6
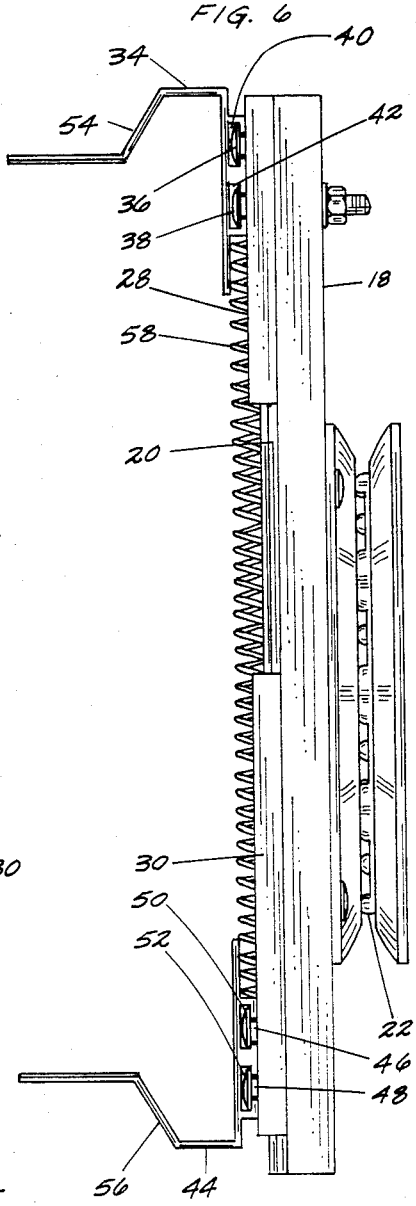

REMOVABLE BOAT SEAT

BACKGROUND OF THE INVENTION

The invention relates generally to removable seats for boats and, more specifically, to a removable and portable seating attachment that will releasably grasp a boat thwart to provide a convenient seat.

Row boats, small fishing boats, canoes, and the like typically have transversely extended seats or thwarts consisting of a generally rectangular piece of metal or wood being relatively thin but of a width to accommodate seating. A user of the boat occupies the thwart while rowing the boat, fishing from the boat, merely during transportation as a passenger, and so on. Being flat and without a supporting back or arms, the thwart is usually uncomfortable and not well suited for the types of activities in which users of these boats typically engage. There is, accordingly, a need for an improved seat that can be removably attached to a conventional thwart and that will aid in the use, operation, and enjoyment of activities in such boats.

A number of devices have attempted to answer this need. For example, the seats disclosed in U.S. Pat. Nos. 1,577,807 and 1,617,805 describe removable seats that may be secured by conventional clamps to a relatively thin, horizontal supporting member such as a boat thwart. Also known are seats as described in U.S. Pat. Nos. 3,113,804 and 3,718,365 which teach seats that slide on rail members or the like mounted transversely of a boat. More recently, a removable boat seat was described in U.S. Pat. No. 3,821,825 which relies on releasable clamping fasteners to secure a two-piece base member of the seat to a boat thwart. The present invention improves upon such prior devices by providing an auxillary seat that is of a convenient, single piece construction and that may be more easily and quickly attached and removed from a boat thwart.

SUMMARY OF THE INVENTION

The invention consists of a removable and portable seat for attachment to a boat thwart or any like having opposing edges. The seat includes a longitudinally extensible main frame base member at either end of which is mounted one of a pair of transverse and opposing grasping members. The grasping members are adapted to engage the opposing edges of the thwart. The base member is extended to separate the grasping members by a distance greater than the width of the thwart. The seat is then placed atop the thwart. A coil spring biases the base member to a retracted position whereupon the grasping members forcefully engage the opposing edges of the thwart to secure the seat to the thwart. A turntable or similar mounting structure is used to attach a seat member to the base member for relative rotation of the seat member about a substantially vertical axis with respect to the base member and the thwart.

BRIEF DESCRIPTION OF THE DRAWINGS

FIG. 4 is an end view of the device illustrated in FIG. 3;

FIG. 5 is a bottom view of the device illustrated in FIG. 3; and

FIG. 6 is a side view of the device illustrated in FIG. 3.

DETAILED DESCRIPTION OF A PREFERRED EMBODIMENT

Figure 1:
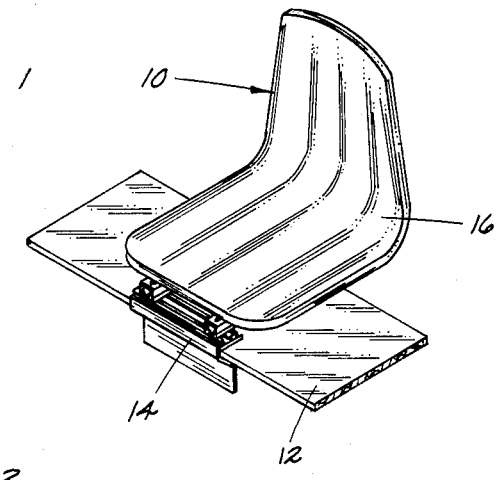
FIG. 1 is a reduced perspective view of the removable boat seat to a boat thwart.
Figure 2:
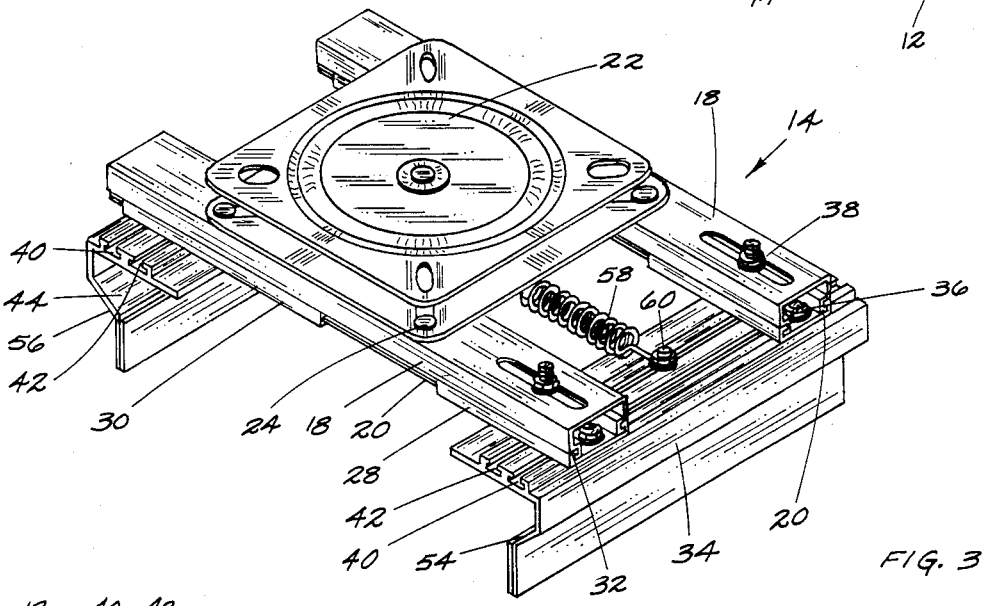
FIG. 2 is a reduced perspective view of the removable boat seat the seat member attached.
Figure 3:
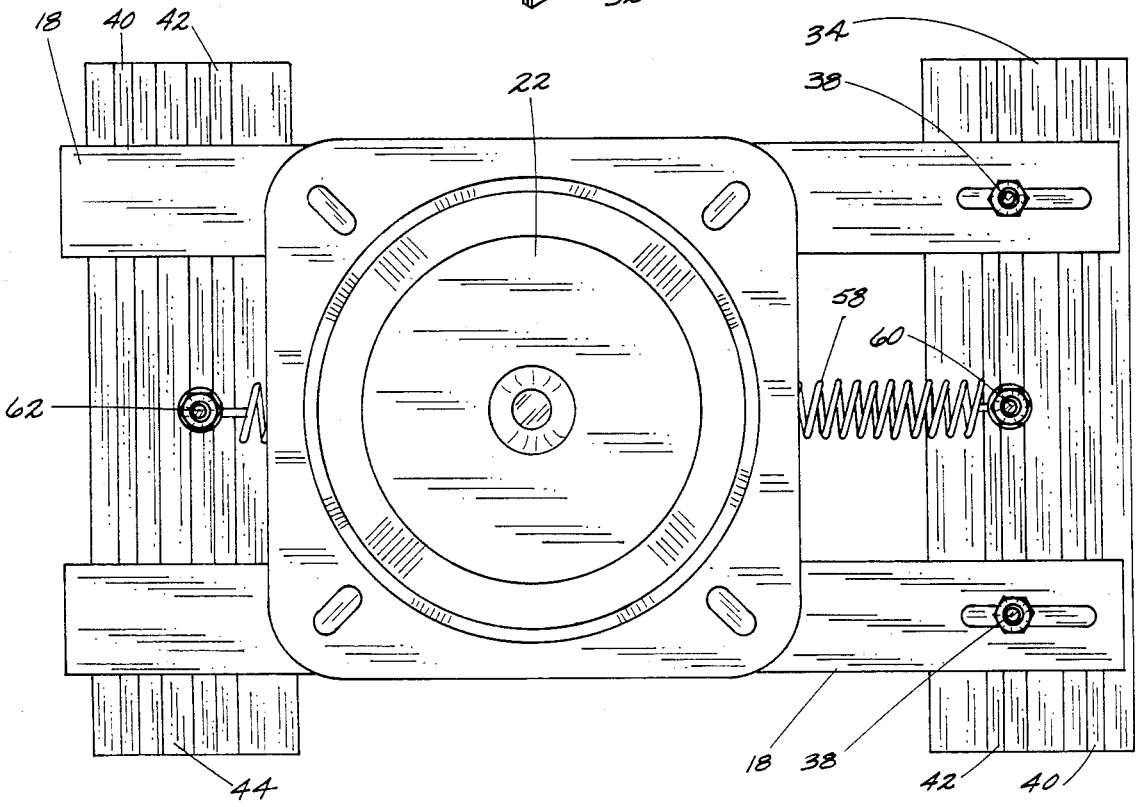
FIG. 3 is a plan view of the removable boat seat without the seat attached.

The invention is illustrated in FIG. 1 at 10 shown attached to a boat seat or thwart 12. The removable boat seat 10 includes a main frame 14 and a seat member 16 which is pivotally attached to the main frame 14 as will be explained more fully below. Seat members of a variety of shapes, sizes, and designs may be attached to the main frame 14, the seat member 16 illustrated being only a simple example of one of the possible choices. Alternatively, the main frame 14 can be used to support a wide variety of other accessory structures or equipment useful or convenient in the function, operation, and enjoyment of the boat or the like.

The main frame 14 includes a pair of longitudinal, generally parallel channel members 18, as illustrated in FIGS. 2–6. The channel members 18 are substantially C-shaped in transverse cross section, as best illustrated in FIG. 4. The flange portions of each channel member 18 form outwardly opening channel sections 20. A turntable 22 is attached to the upper surface of each of the channel members 18 by means of nut and bolt combinations 24 received through slots 26, best illustrated in FIG. 5. When firmly secured, the nut and bolt combinations 24 and the turntable 22 hold the channel members 18 in a substantially rigid and parallel, spaced apart relation.

Adapted for sliding engagement with the channel members 18 are two pair of slide members, rearward slide members 28 and forward slide members 30. Each of the pair of slide members 28 and 30 is substantially C-shaped in transverse cross section, having upwardly extended flange portions which terminate with inwardly extended lip sections 32. The slide members 28 and 30 are of a size such that lip sections 32 are slidably received inside the channel sections 20 of the channel members 18 so that longitudinal movement of the slide members 28 and 30 with respect to the channel members 18 is permitted, whereas movement of the slide members 28 and 30 in any direction transverse to the channel members 18 is prohibited.

Extended transversely of the main frame 14 is a rearward grasping member 34 which is adjustably attached to the bottom surface of the rearward slide members 28 by means of a nut and bolt combination 36. The rearward grasping member 34 is also attached to the rearward end portion of channel members 18 by means of nut and bolt combinations 38. In assembly relation, the bolt heads of the nut and bolt combinations 36 and 38 are slidably received inside a pair of slotted channels 40 and 42, respectively, of the rearward grasping member 34. This mounting arrangement permits, when nut and bolt combinations 36 and 38 are loosened, the rearward grasping member 34 to be relatively transversely displaced with respect to the channel members 18 and rearward slide members 28. When the nut and bolt combinations 36 and 38 are tightened, however, the rearward grasping member 34 will be secured to the channel members 18 and the rearward slide members 28. In a like fashion, a forward grasping member 44 is attached to the underside of the forward slide members 30 by means of the nut and bolt combinations 46 and 48 the bolt heads of which are received inside slotted channels 50 and 52, respectively, of the forward grasping member 44.

When mounted as a part of the main frame 14, the grasping members 34 and 44 present inwardly and downwardly extended portions 54 and 56, respectively. The structure of the main frame 14 is completed by a coil spring 58 either end of which is attached to the grasping members 34 and 44 by means of nut and bolt combinations 60 and 62, respectively. The coil spring 58 acts to urge the grasping members 34 and 44 toward each other. The forward grasping member 44 may be extended relative to the rearward grasping member 34 by the exertion of a longitudinal force between the two grasping members greater than the closing or retracting force exerted by the coil spring 58. When the force of the coil spring 58 is exceeded, the forward slide members 30 will slide on channel members 18 thereby maintaining the substantially parallel relationship between the grasping members 34 and 44 but increasing the relative longitudinal displacement therebetween. If the extensing force is removed, the coil spring 58 will act to return the forward grasping member 44 to its retracted or non-extended position. The FIGS. 1-6 all depict the main frame 14 in a partially extended (or partially retracted) condition.

In use, an appropriate seat member 16 is secured to the top of the turntable 22 which then permits relative rotation of the seat member 16 about an axis substantially perpendicular to the channel members 18 of the main frame 14. To removably attach the boat seat 10 to a horizontal supporting member, e.g., the boat thwart 12, the rearward grasping member 34 is preferably positioned atop and adjacent a rearward opposing vertical edge of the supporting member or thwart 12 such that the bottom of the main frame near the rearward grasping member 34 is supported on the thwart and the extended option 54 is in contact with the rearward edge of the thwart. A force is then exerted on the forward grasping member 44 to extend the main frame 14 until the extended portion 56 of the forward grasping member 44 clears the opposing vertical edge of the supporting member or thwart. The boat seat is then lowered to place the forward bottom surface of the main frame in contact with the upper surface of the supporting member or thwart. The extensing force is then released. The coil spring causes the grasping members to engage the opposing edges of the supporting member or thwart to releasably secure the boat seat to the supporting member or thwart.

The main frame of the preferred embodiment is constructed primarily of aluminum. Any other strong and lightweight material, such as plastic, could be used.

It should be clear from the foregoing description of the preferred embodiment that other means could be employed in accomplishing the broad purposes of the invention. It should be understood that this description is intended to illustrate but not limit the scope of the invention as defined in the following claims.

I claim:

1. A seat for removable attachment to a boat thwart or any like structure having opposing edges, comprising:

a. a main frame continuously longitudinally extensible between an extended position and a retracted position;

b. a pair of grasping members, mounted to either end of said main frame and including a plurality of spaced parallel lengthwise slots, for engaging the thwart edges;

c. said main frame including a pair of substantially parallel channel members having upper and lower surfaces with slide portions formed on their lower surfaces; a pair of substantially parallel first slide members mounted in an adjustably spaced apart relation to one of said grasping members, and a pair of substantially parallel matching second slide members mounted in an adjustably spaced apart relation to the other of said grasping members, each of said first and second slide members being slidably mounted to the slide portions of the channel members.

d. said first and second and slide members include releasable attachment means slidably received within said slots for adjustably mounting said first and second and slide members to said grasping members;

e. means extending between the grasping members for biasing said grasping members toward a retracted position to secure said main frame to the thwart;

f. a turntable mounted on the upper surface of said channel members of said main frame; and g. a seat member mounted on said turntable for rotation about a generally vertical axis.

* * * * *